US008205979B2

(12) United States Patent
Nishitani et al.

(10) Patent No.: US 8,205,979 B2
(45) Date of Patent: Jun. 26, 2012

(54) LIQUID EJECTION HEAD

(75) Inventors: Eisuke Nishitani, Tokyo (JP); Toru Yamane, Yokohama (JP); Tomoyuki Inoue, Tokyo (JP); Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 12/636,109

(22) Filed: Dec. 11, 2009

(65) Prior Publication Data

US 2010/0149293 A1 Jun. 17, 2010

(30) Foreign Application Priority Data

Dec. 17, 2008 (JP) ..... 2008-321643

(51) Int. Cl.

| | |
|---|---|
| ***B41J 2/175*** | (2006.01) |
| ***B41J 2/15*** | (2006.01) |
| ***B41J 2/14*** | (2006.01) |
| ***B41J 2/05*** | (2006.01) |

(52) U.S. Cl. ..... 347/93; 347/40; 347/47; 347/65

(58) Field of Classification Search ..... 347/40, 347/47, 65, 93

See application file for complete search history.

(56) References Cited

U.S. PATENT DOCUMENTS

| | | | | |
|---|---|---|---|---|
| 5,296,875 | A * | 3/1994 | Suda | 347/93 |
| 6,916,090 | B2 * | 7/2005 | Valley et al. | 347/93 |
| 7,044,591 | B2 * | 5/2006 | Taira | 347/93 |
| 7,108,352 | B2 | 9/2006 | Muraoka | |
| 7,503,644 | B2 * | 3/2009 | Hori | 347/65 |
| 2006/0232637 | A1 | 10/2006 | Matsui | |

FOREIGN PATENT DOCUMENTS

| | | |
|---|---|---|
| JP | 2005-001379 | 1/2005 |
| JP | 2006-315395 | 11/2006 |

* cited by examiner

*Primary Examiner* — Matthew Luu
*Assistant Examiner* — Jannelle M Lebron
(74) *Attorney, Agent, or Firm* — Canon USA Inc IP Division

(57) ABSTRACT

A liquid ejection head includes ejection orifices allowing liquid to be ejected therethrough, passages communicating with the ejection orifices and the pressure chambers each accommodating an energy generating element generating energy for ejecting the liquid therein, a supply port supplying the liquid to the passages, and a filter including substantially cylindrical members between the supply port and passages and having openings. Each of the ejection orifices has a substantially circular cross section having larger and smaller diameters substantially perpendicularly to its liquid ejecting direction. Each of the openings has a substantially rectangular cross section having longer and shorter sides substantially perpendicularly to its liquid supplying direction. The relationships D1>L1, D1<D2, and D2>L2≧D1 are satisfied where D1 is the smaller diameter, D2 is the larger diameter, L1 is the shorter side, and L2 is the longer side.

5 Claims, 8 Drawing Sheets

LIQUID EJECTION HEAD

BACKGROUND OF THE INVENTION

1. Field of the Invention

The present invention relates to a liquid ejection head configured to eject liquid to record information on a recording medium by the ink-jet method.

2. Description of the Related Art

A liquid ejection head is known that has a filter disposed between a passage and an ink supply port in order to prevent a clogging of an ejection orifice with foreign matter, such as dust, contained in ink. One known example of a recording head having a filter is illustrated in FIGS. 6A to 6C. FIG. 6A illustrates nozzles and their adjacent areas of the recording head; FIG. 6B is a cross-sectional view taken along the line VIB-VIB in FIG. 6A; and FIG. 6C is a cross-sectional view taken along the line VIC-VIC in FIG. 6A.

The recording head of this example has a configuration in which a filter 301 having a substantially rectangular opening with the shorter side L1 and the longer side L2 and a substantially circular ejection orifice 100 for allowing ink to be ejected therethrough with the diameter D1 (=D2).

There is a desire for smaller droplets to be ejected and higher resolution in recording in order to achieve further higher image quality. To attain the desire, it is necessary to reduce the size of an ejection orifice of a recording head and increase the resolution of a nozzle array. In this case, the distance between nozzles is reduced and thus the width of a nozzle wall forming a partition between the nozzles is reduced, so a problem arises in that adhesion to a substrate cannot be sufficiently maintained. One known approach to addressing this problem is a liquid ejection head that has a substantially oval ejection orifice, as illustrated in FIGS. 7A to 7C. The recording head of the example illustrated in FIGS. 7A to 7C has a filter having a substantially rectangular opening with the shorter side L1 and the longer side L2 and a substantially oval ejection orifice for allowing ink to be ejected therethrough with the minor diameter D1 and the major diameter D2.

Another known approach to increasing the resolution of a nozzle array is a technique for maintaining a sufficient clearance between nozzles and a sufficient thickness of each nozzle wall by the use of an arrangement of staggered pressure chambers, as illustrated in Japanese Patent Laid-Open No. 2005-1379 and No. 2006-315395.

With a configuration that satisfies the relations D1>L1, D1>L2, D2>L1, and D2>L2, as illustrated in FIGS. 6A to 6C, an entry of foreign matter into a pressure chamber can be reduced. However, a problem remains in that the ink supply performance from a liquid chamber communicating with a supply port to the pressure chamber deteriorates.

Here, a case is discussed where the size of an ejection orifice is reduced to increase the resolution of a nozzle in order to fulfill the desire for higher image quality. With the configuration that satisfies the relations D1>L1, D1>L2, D2>L1, and D2>L2, as illustrated in FIGS. 6A to 6C, D1 and D2 are reduced with a reduction in the size of the ejection orifice. From the above relations, this results in a reduction in L1 and L2, so the ink supply performance from the liquid chamber to the nozzles deteriorates. With the aim of solving this problem, the liquid ejection head illustrated in FIGS. 7A to 7C has a configuration that satisfies the relations L1>D1 and L2>D2. Unfortunately, with this configuration, if foreign matter enters the pressure chamber, it is difficult to discharge the foreign matter through the ejection orifice to the outside and it may cause a clogging of the ejection orifice.

With the configuration using staggered pressure chambers, a problem arises in that the ink supply performance to a pressure chamber having a longer distance from the ink supply port deteriorates. Therefore, even with this configuration using the staggered formation, it is desired to improve the ink supply performance.

SUMMARY OF THE INVENTION

The present invention provides a liquid ejection head capable of maintaining sufficient ink supply performance from a liquid chamber to a pressure chamber for achieving a higher image quality and of, even if foreign matter enters the pressure chamber, discharging it through an ejection orifice to the outside.

According to an aspect of the present invention, a liquid ejection head includes a plurality of ejection orifices, a plurality of passages, a supply port, and a filter. The plurality of ejection orifices is configured to allow liquid to be ejected therethrough. The plurality of passages communicates with the plurality of respective ejection orifices and with a plurality of respective pressure chambers. Each of the plurality of pressure chambers accommodates an energy generating element therein. The energy generating element is configured to generate energy for ejecting the liquid. The supply port is configured to supply the liquid to the plurality of passages. The filter includes a plurality of substantially cylindrical members arranged in a region between the supply port and the plurality of passages and has a plurality of openings. Each of the plurality of ejection orifices has a cross section having a substantially circular shape with a larger diameter and a smaller diameter in a direction substantially perpendicular to a direction in which the liquid is ejected. Each of the plurality of openings of the filter has a cross section having a substantially rectangular shape with a longer side and a shorter side in a direction substantially perpendicular to a direction in which the liquid is supplied. The following relationships D1>L1, D1<D2, and D2>L2≧D1 are satisfied where D1 is the smaller diameter of the ejection orifice, D2 is the larger diameter, L1 is the shorter side of the opening, and L2 is the longer side.

With the present invention, sufficient ink supply performance from a supply port to a pressure chamber can be maintained for achieving a higher image quality, an entry of foreign matter into the pressure chamber can be reduced, and even if foreign matter enters the pressure chamber, it can be discharged through an ejection orifice to the outside.

Further features of the present invention will become apparent from the following description of exemplary embodiments (with reference to the attached drawings).

DESCRIPTION OF THE EMBODIMENTS

The present invention is described using an ink-jet recording technique as an example of an application of the present invention. However, the applicability of the present invention is not limited to this example. For example, it is also applicable to producing a biochip and printing an electronic circuit. A liquid ejection head can be incorporated in a device, such as a printer, a copier, a facsimile machine having a communication system, and a word processor having a printer portion, and also in a multifunctional industrial recording apparatus in which various devices are combined. For example, it can be used in biochip production, electronic-circuit printing, and spraying a drug. In addition, the liquid ejection head can be used in recording on various recording media, including paper, a thread, a fiber, a fabric, leather, a metal, a plastic, glass, lumber, and ceramic.

It is to be noted that "recording" used in this specification indicates both applying an image having meaning, such as characters and graphics, and applying an image having no meaning, such as a pattern, to a recording medium.

Exemplary embodiments of the present invention will be described in detail below with reference to the accompanying drawings.

First, a general configuration of a liquid ejection head according to the embodiments is described.

Figure 8:
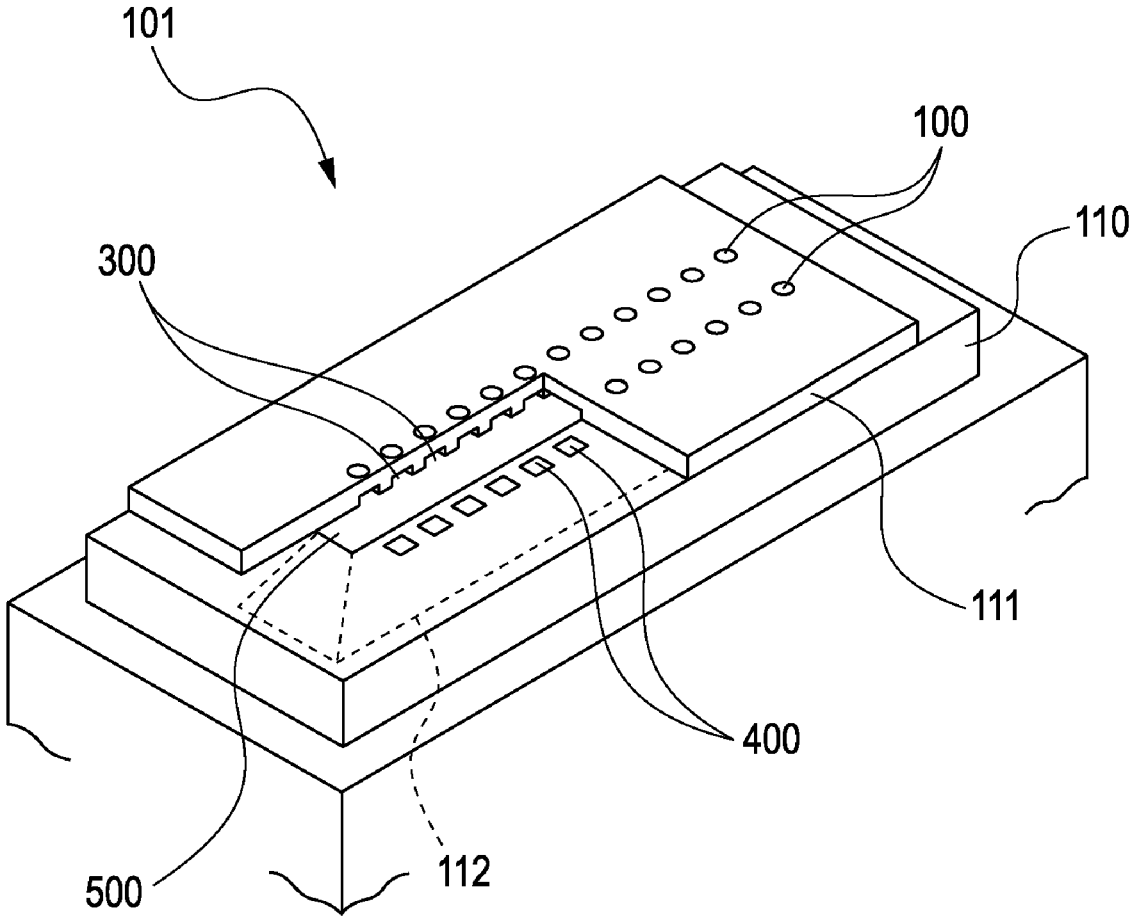
FIG. 8 is a perspective view of a liquid ejection head according to the present invention.

FIG. 8 is a cutaway perspective view of a liquid ejection head 101 according to an exemplary embodiment of the present invention. An element substrate 110 is provided with a plurality of recording elements 400. Each of the recording elements 400 is an energy generating element configured to generate energy for use in ejecting liquid. The main surface of the element substrate 110 is overlaid with a passage forming member 111 forming a plurality of ink passages. The main surface of the element substrate 110 and the passage forming member 111 are bonded. The element substrate 110 can be made of, for example, glass, ceramic, a polymer, or a metal, and typically made of silicon. For each ink passage, the recording element 400, an electrode (not shown) for applying a voltage to the recording element 400, and wiring (not shown) connected to the electrode are provided on the main surface of the element substrate 110. Each of the recording element 400, the electrode, and the wiring is formed from a predetermined wiring pattern. The main surface of the element substrate 110 is provided with an insulating film (not shown) for improving divergence of thermal storage such that the insulating film covers the recording element 400. The main surface of the element substrate 110 is also provided with a protective film (not shown) for protection against cavitation occurring when bubbles dissipate such that the protective film covers the insulating film.

As illustrated in FIG. 8, the passage forming member 111 includes a plurality of ink passages (nozzles) 300 through which ink flows, an ink supply port 500 for supplying ink to the nozzles 300, and a plurality of ejection orifices 100 for allowing ink droplets to be ejected therethrough. The ejection orifices 100 are distal openings of their respective nozzles 300 and disposed at locations that face their respective recording elements 400 on the element substrate 110. The ink supply port 500 communicates with a common liquid chamber 112.

The liquid ejection head 101 includes the plurality of recording elements 400 and the plurality of nozzles 300 on the element substrate 110. The nozzles 300 are arranged in a first nozzle array and a second nozzle array facing the first nozzle array. The ink supply port 500 is disposed between the first and second nozzle arrays. In each of the first and second nozzle arrays, the longitudinal directions of the nozzles 300 are arranged in parallel to one another. The first and second nozzle arrays are formed such that the interval between the neighboring nozzles corresponds to 1200 dpi. The nozzles 300 in the second nozzle array can be arranged so as to have a pitch displaced from that in the first nozzle array as needed for reasons of dot arrangement.

A nozzle structure of the liquid ejection head being a main part of the present invention will now be described below.

First Embodiment

Figure 1C:
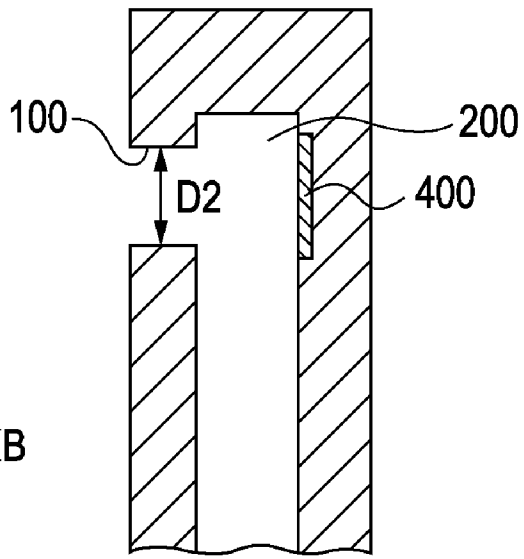
FIGS. 1A to 1C are a schematic diagram and cross-sectional views of nozzles and their adjacent areas according to a first embodiment of the present invention.
Figure 1A:
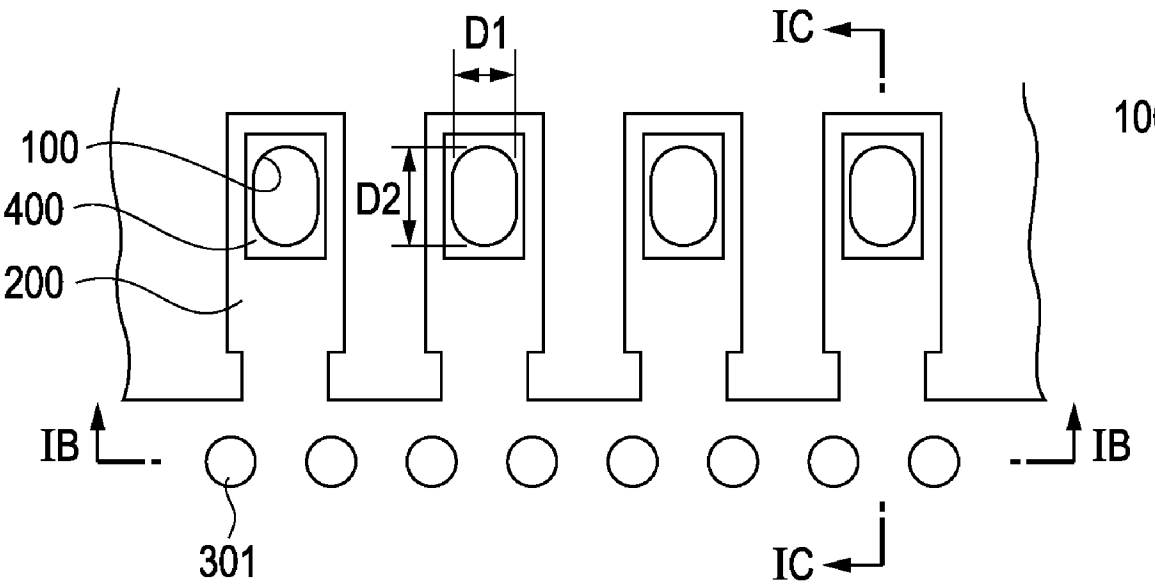
Figure 1B:
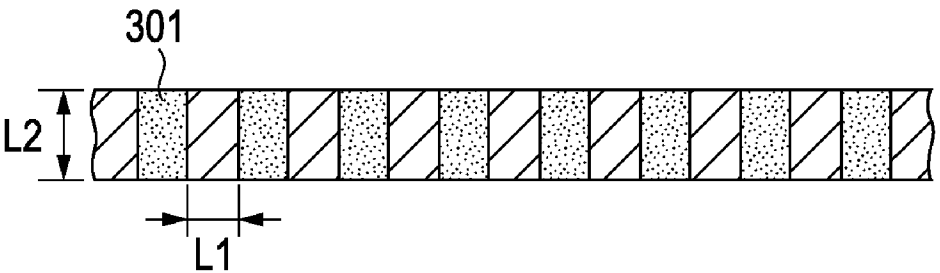

FIGS. 1A to 1C illustrate a nozzle structure and its cross section of a liquid ejection head according to a first embodiment of the present invention. FIG. 1A is a perspective plan view that illustrates part of the nozzles of the liquid ejection head from a direction substantially perpendicular to the substrate. FIG. 1B is a cross-sectional view of a filter array taken along the line IB-IB in FIG. 1A. FIG. 1C is a cross-sectional view of a pressure chamber taken along the line IC-IC in FIG. 1A.

In the present embodiment, the recording element 400 is arranged inside a pressure chamber 200 having a first end communicating with the ejection orifice 100 and a second end communicating with the ink supply port 500. A nozzle filter 301 is disposed in a region between the ink supply port 500 and the passages. In the present embodiment, the nozzle filter 301 has a plurality of substantially cylindrical (substantially circular cylindrical) sections and is disposed between the pressure chamber 200 and the ink supply port 500.

Referring to FIGS. 1A to 1C, the dimensions of each portion according to the present embodiment are described below. The nozzle pitch in an arrangement direction in which the plurality of nozzles are arranged is approximately 21.7 μm. The ejection orifice 100 has a substantially oval shape with a minor diameter D1 of approximately 8.8 μm and a major diameter D2 of approximately 16.1 μm. The nozzle filter 301 has a substantially rectangular opening with a shorter side L1 of approximately 8.0 μm and a longer side L2 of approximately 14.0 μm.

Accordingly, in the present embodiment, the relationships $D1>L1$ and $D2>L2 \geqq D1$ are satisfied. The conditions $D1>L1$ and $D2>L2$ ensure the dimensions required for minimizing an entry of foreign matter into the pressure chamber and, if foreign matter enters the pressure chamber, discharging the foreign matter through the ejection orifice to the outside. In addition, the condition $L2 \geqq D1$ enables the size of the opening of the filter to be increased, thus providing the advantage of facilitating an ink flow from the ink supply port 500 to the pressure chamber 200. That is, with the present embodiment, both the ink supply function and the reliable filter function, which intrinsically conflict with each other, can be carried out. The nozzle filter 301 according to the present embodiment can be produced by photolithography. In the present embodiment, in the step of patterning by photolithography for the nozzle 300 and the pressure chamber 200, patterning for the nozzle filter is also performed. This is useful because the nozzle filter can be produced without having to increase the number of steps.

Second Embodiment

Figure 2C:
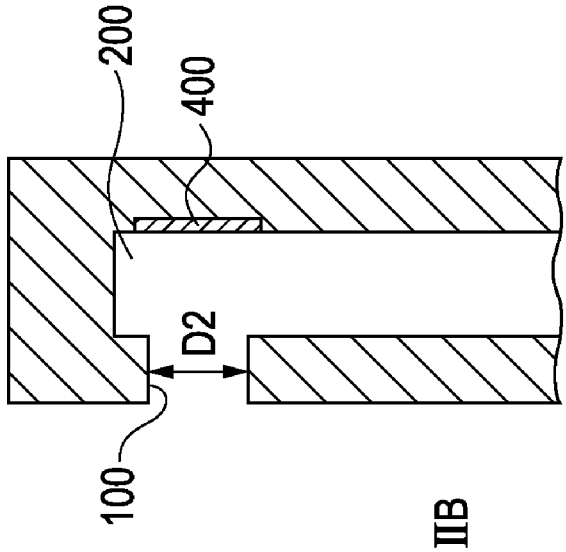
FIGS. 2A to 2C are a schematic diagram and cross-sectional views of nozzles and their adjacent areas according to a second embodiment of the present invention.
Figure 2A:
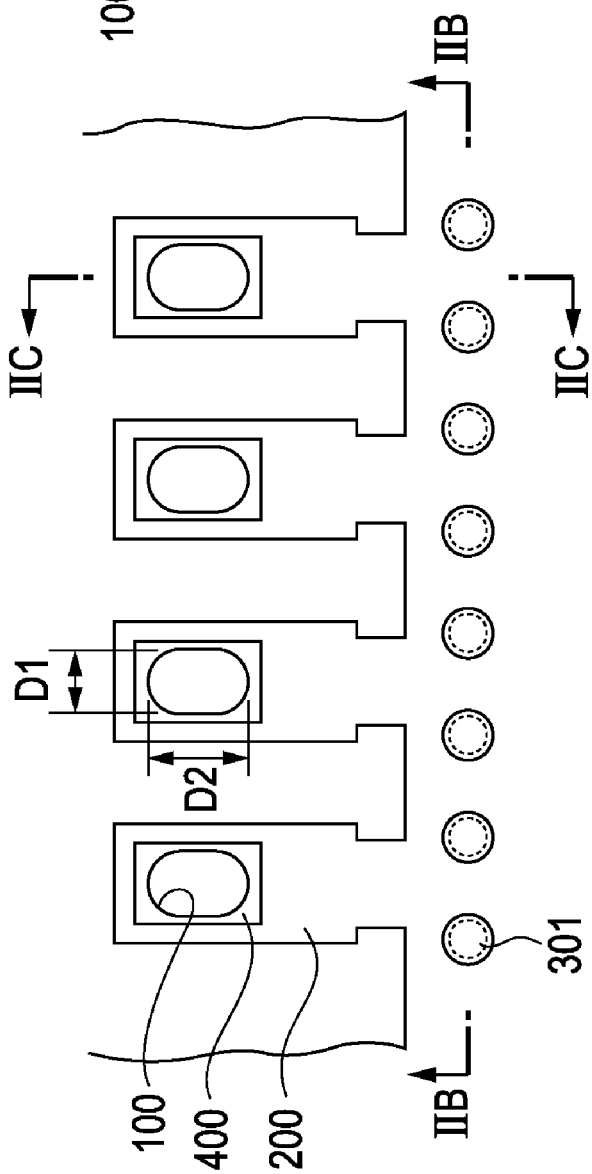
Figure 2B:
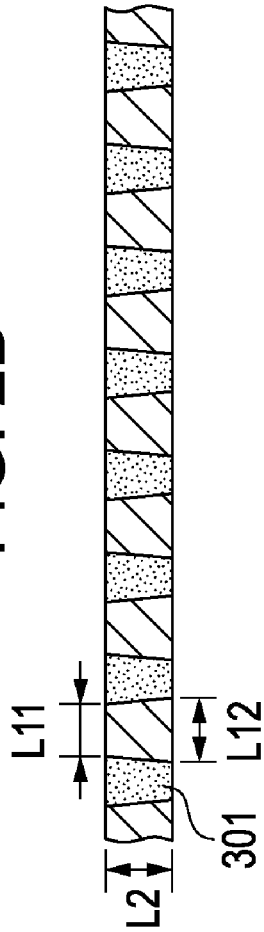

FIGS. 2A to 2C illustrate a nozzle structure and its cross section of a liquid ejection head according to a second embodiment of the present invention. FIG. 2A is a perspective plan view that illustrates part of the nozzles of the liquid ejection head from a direction substantially perpendicular to the substrate. FIG. 2B is a cross-sectional view of a filter array taken along the line IIB-IIB in FIG. 2A. FIG. 2C is a cross-sectional view of a pressure chamber taken along the line IIC-IIC in FIG. 2A. Components having similar configurations to those in the first embodiment are indicated by the same reference numerals as in the first embodiment, and the description thereof is not repeated here.

In the present embodiment, the nozzle filter 301 has the shape of a substantially conical frustum and is disposed between the pressure chamber 200 and the ink supply port 500.

Referring to FIGS. 2A to 2C, the dimensions of each portion according to the present embodiment are described below. The nozzle pitch in an arrangement direction in which the plurality of nozzles are arranged is approximately 21.7 μm. The ejection orifice 100 has a substantially oval shape with a minor diameter D1 of approximately 8.8 μm and a major diameter D2 of approximately 16.1 μm. The nozzle filter 301 has a substantially trapezoidal opening with an upper base L11 of approximately 8.0 μm, a lower base L12 of approximately 8.6 μm, and a height L2 of approximately 9.0 μm.

Accordingly, in the present embodiment, the relationships D1>L11, D1>L12, and D2>L2≧D1 are satisfied. The conditions D1>L11, D1>L12, and D2>L2 ensure the dimensions required for minimizing an entry of foreign matter into the pressure chamber and, if foreign matter enters the pressure chamber, discharging the foreign matter through the ejection orifice to the outside. In addition, the condition L2≧D1 enables the size of the opening of the filter to be increased, thus providing the advantage of facilitating an ink flow from the common liquid chamber to the pressure chamber.

Third Embodiment

Figure 3D:
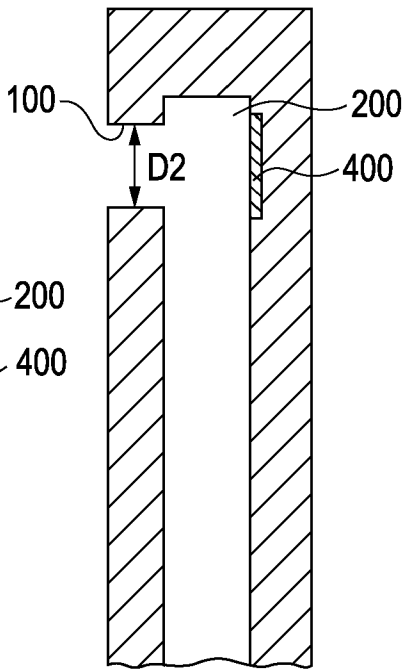
FIGS. 3A to 3D are a schematic diagram and cross-sectional views of nozzles and their adjacent areas according to a third embodiment of the present invention.
Figure 3C:
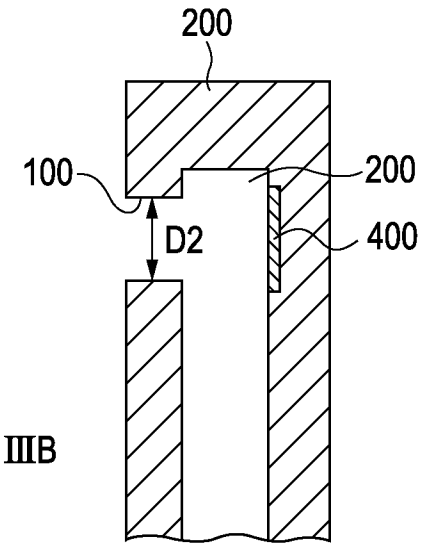
Figure 3A:
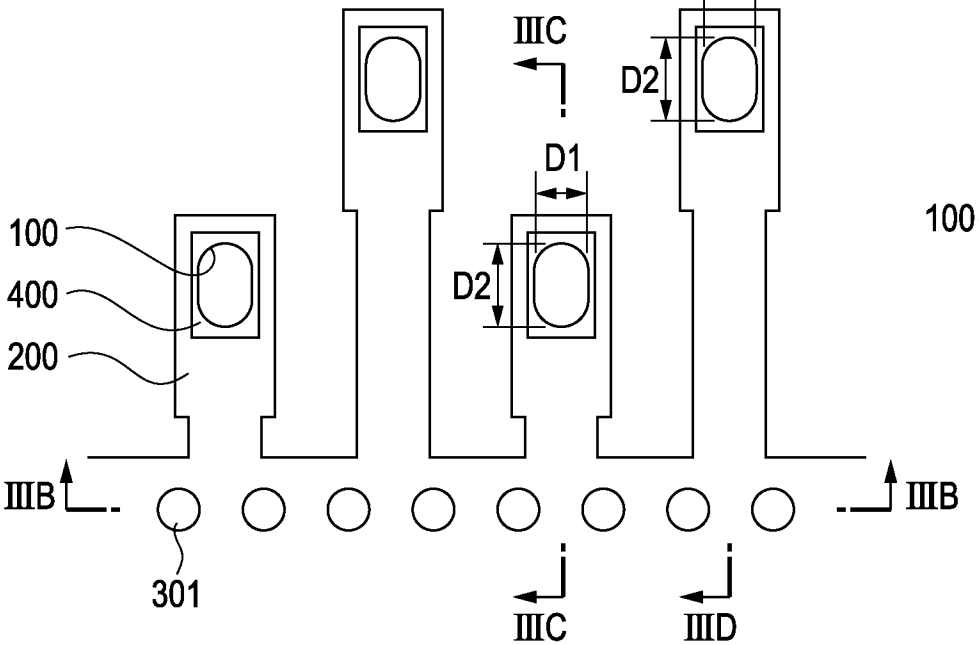
Figure 3B:
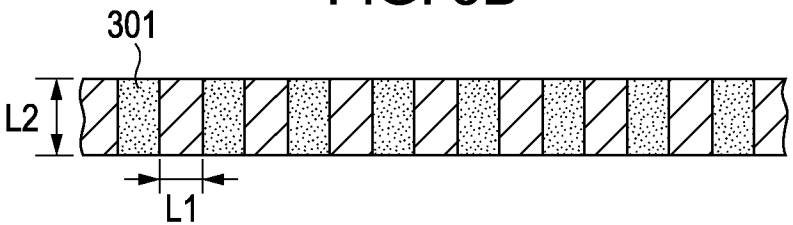

FIGS. 3A to 3D illustrate a nozzle structure and its cross section of a liquid ejection head according to a third embodiment of the present invention. FIG. 3A is a perspective plan view that illustrates part of the nozzles of the liquid ejection head from a direction substantially perpendicular to the substrate. FIG. 3B is a cross-sectional view of a filter array taken along the line IIIB-IIIB in FIG. 3A. FIG. 3C is a cross-sectional view of a pressure chamber taken along the line IIIC-IIIC in FIG. 3A. FIG. 3D is a cross-sectional view of another pressure chamber taken along the line IIID-IIID in FIG. 3A.

The dimensions of the ejection orifice 100 and the opening of the nozzle filter 301 are the same as in the first embodiment. The present embodiment is different from the first embodiment in that the pressure chambers 200 are staggered so as to have different distances from the ink supply port 500.

With the present embodiment, in addition to the advantage described in the first embodiment, the advantage of improving the ink supply performance to the pressure chambers 200 having a longer distance from the ink supply port 500, this ink supply performance being especially an issue in the ink supply function, is provided. In the present embodiment, as long as the conditions D1>L1 and D2>L2≧D1 are satisfied, the openings of the nozzle filter may have different sizes. For example, an opening of the nozzle filter corresponding to a long nozzle can be larger in size than that corresponding to a short nozzle having a passage length shorter than that of the long nozzle. In this case, the refilling capability of the long nozzle can be improved, and the fluid characteristics of the long and short nozzles can be set in a useful range.

Fourth Embodiment

Figure 4D:
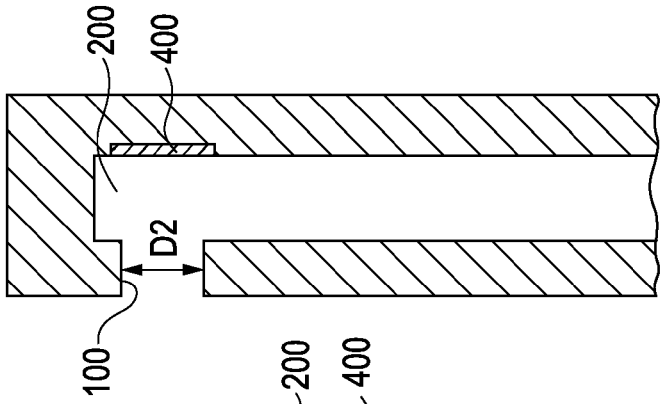
FIGS. 4A to 4D are a schematic diagram and cross-sectional views of nozzles and their adjacent areas according to a fourth embodiment of the present invention.
Figure 4C:
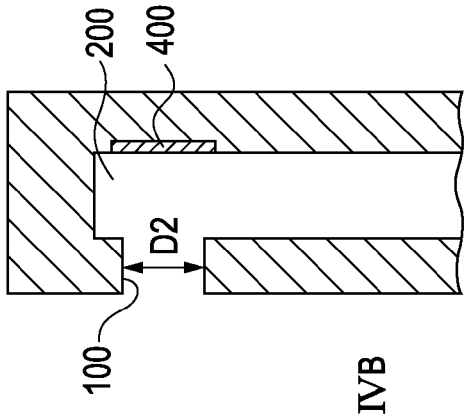
Figure 4A:
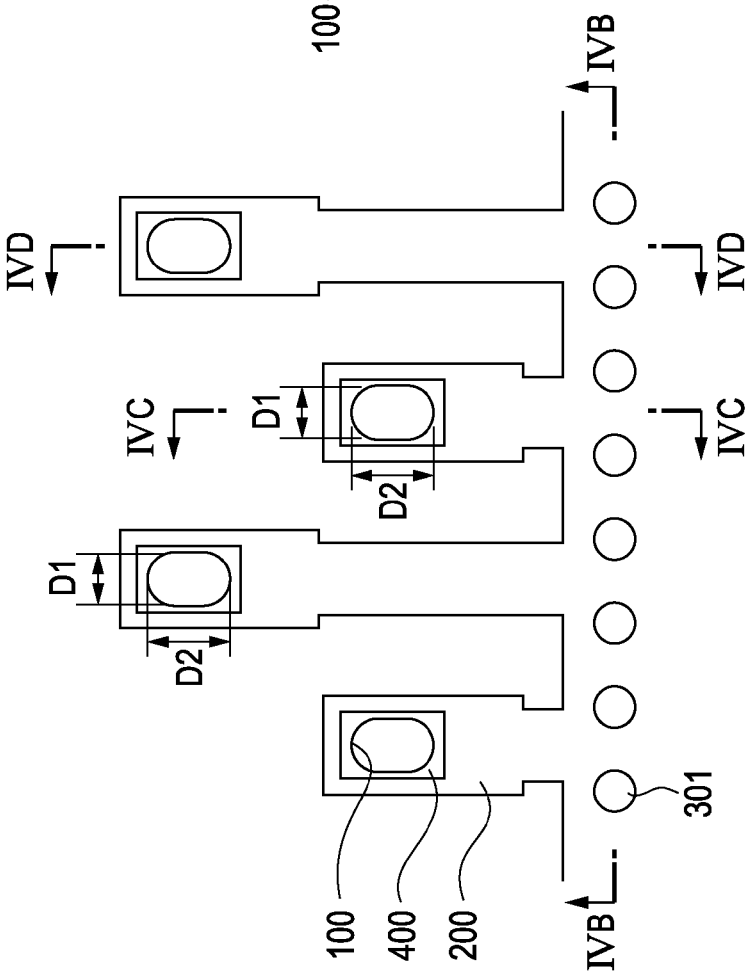
Figure 4B:
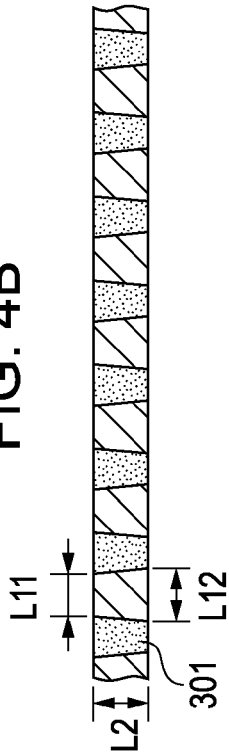

FIGS. 4A to 4D illustrate a nozzle structure and its cross section of a liquid ejection head according to a fourth embodiment of the present invention. FIG. 4A is a perspective plan view that illustrates part of the nozzles of the liquid ejection head from a direction substantially perpendicular to the substrate. FIG. 4B is a cross-sectional view of a filter array taken along the line IVB-IVB in FIG. 4A. FIG. 4C is a cross-sectional view of a pressure chamber taken along the line IVC-IVC in FIG. 4A. FIG. 4D is a cross-sectional view of another pressure chamber taken along the line IVD-IVD in FIG. 4A.

The dimensions of the ejection orifice 100 and the opening of the nozzle filter 301 are the same as in the second embodiment. The present embodiment is different from the second embodiment in that the pressure chambers 200 are staggered so as to have different distances from the ink supply port 500.

With the present embodiment, in addition to the advantage described in the first embodiment, the advantage of improving the ink supply performance to the pressure chambers 200 having a longer distance from the ink supply port 500, this ink supply performance being especially an issue in the ink supply function, is provided.

Fifth Embodiment

Figure 5C:
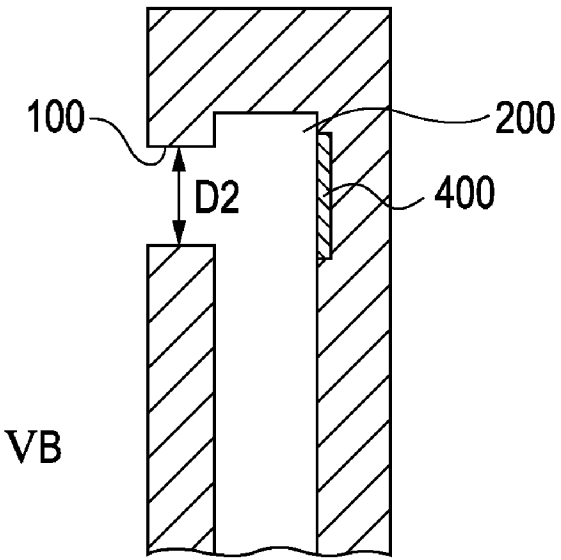
FIGS. 5A to 5C are a schematic diagram and cross-sectional views of nozzles and their adjacent areas according to a fifth embodiment of the present invention.
Figure 5A:
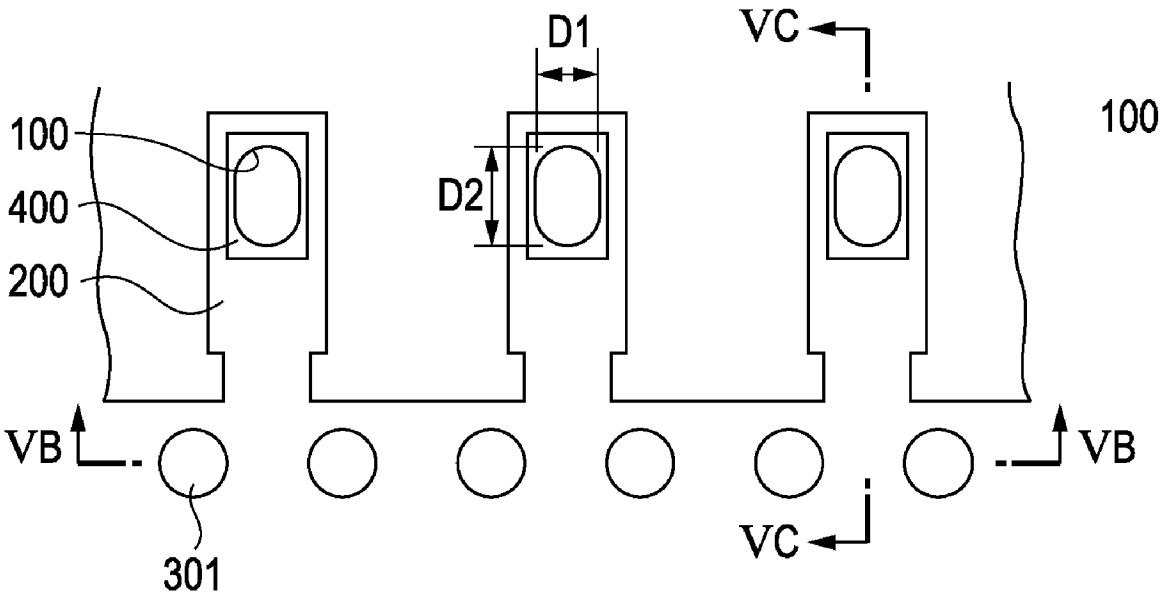
Figure 5B:
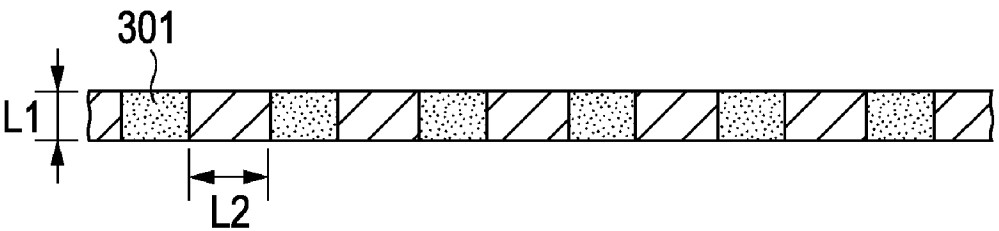
Figure 6C:
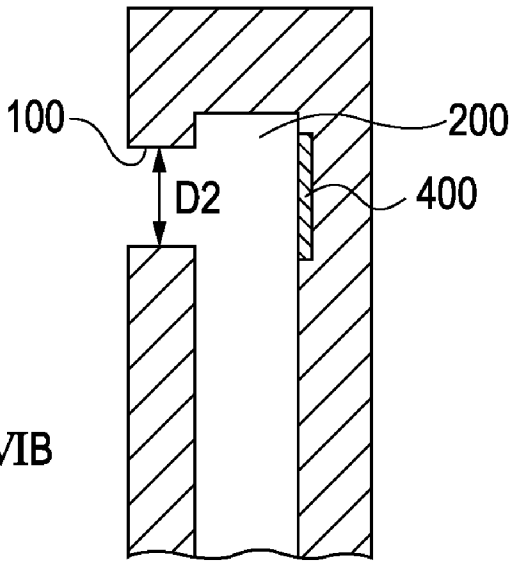
FIGS. 6A to 6C are a schematic diagram and cross-sectional views of nozzles and their adjacent areas of a traditional recording head.
Figure 6A:
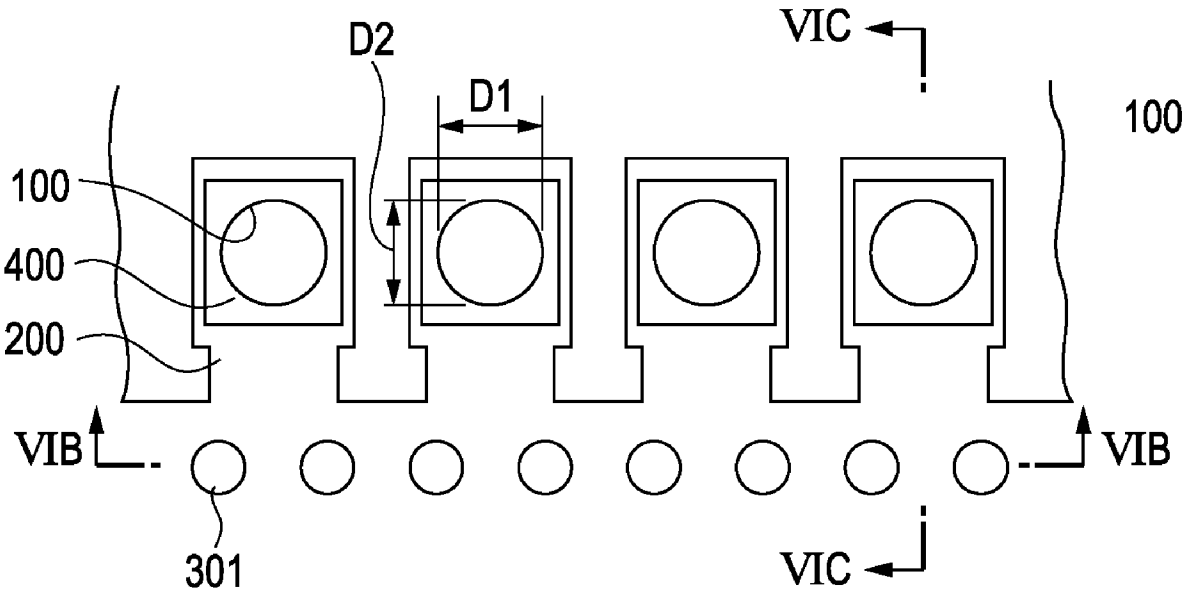
Figure 6B:
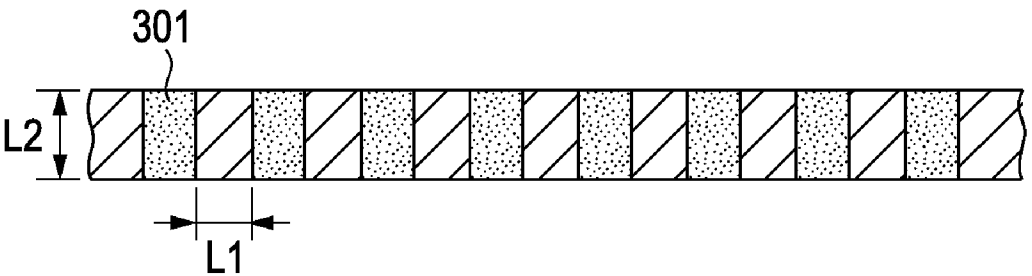
Figure 7C:
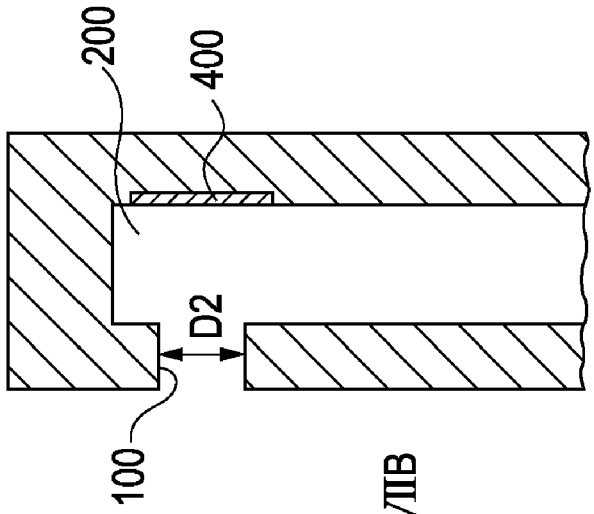
FIGS. 7A to 7C are a schematic diagram and cross-sectional views of nozzles and their adjacent areas of another traditional recording head.
Figure 7A:
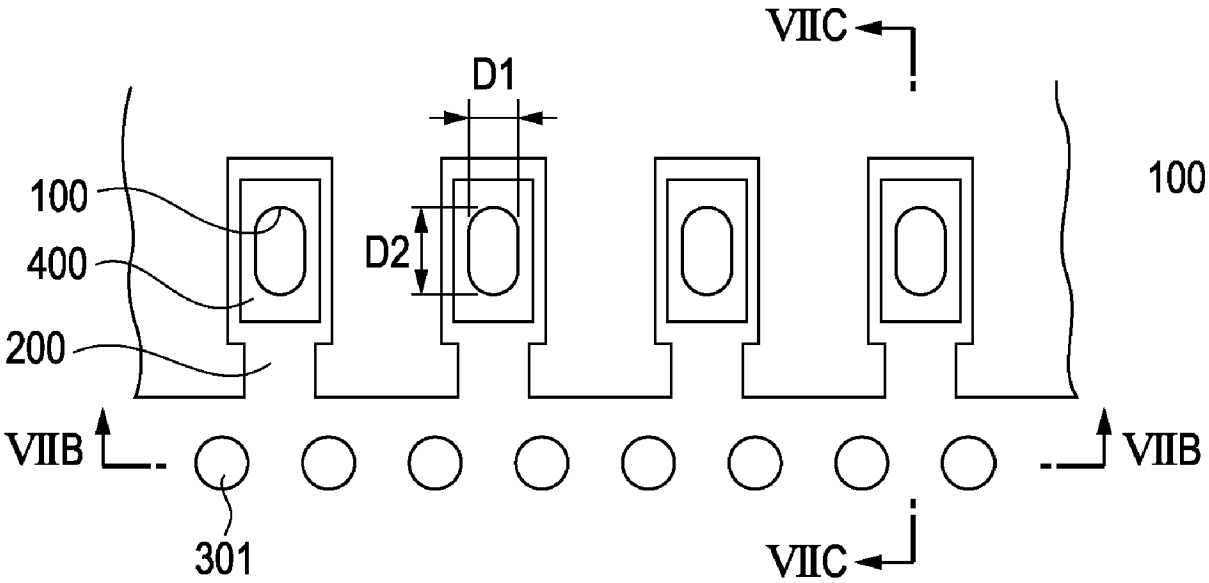
Figure 7B:
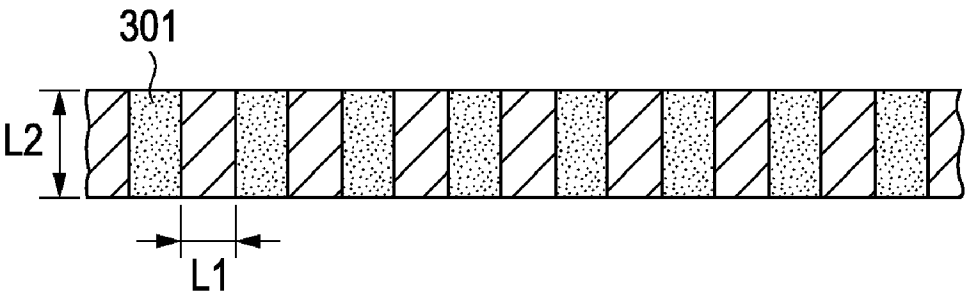

FIGS. 5A to 5C illustrate a nozzle structure and its cross section of a liquid ejection head according to a fifth embodiment of the present invention. FIG. 5A is a perspective plan view that illustrates part of the nozzles of the liquid ejection head from a direction substantially perpendicular to the substrate. FIG. 5B is a cross-sectional view of a filter array taken along the line VB-VB in FIG. 5A. FIG. 5C is a cross-sectional view of a pressure chamber taken along the line VC-VC in FIG. 5A.

Referring to FIGS. 5A to 5C, the dimensions of each portion according to the present embodiment are described below. The nozzle pitch in an arrangement direction in which the plurality of nozzles are arranged is approximately 42.5 μm. The ejection orifice 100 has a substantially oval shape with a minor diameter D1 of approximately 8.8 μm and a major diameter D2 of approximately 16.1 μm. The nozzle filter 301 has a substantially rectangular opening with a shorter side L1 of approximately 8.0 μm and a longer side L2 of approximately 14.0 μm.

The present embodiment is different from the first embodiment in that the width (L2) of the opening of the nozzle filter is longer than the height (L1) of the opening. In the present embodiment, the relationships D1>L1 and D2>L2≧D1 are satisfied. The conditions D1>L1 and D2>L2 ensure the dimensions required for minimizing an entry of foreign matter into the pressure chamber and, if foreign matter enters the pressure chamber, discharging the foreign matter through the ejection orifice to the outside. In addition, the condition L2≧D1 enables the size of the opening of the filter to be increased, thus providing the advantage of facilitating an ink flow from the ink supply port 500 to the pressure chamber 200.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-321643 filed Dec. 17, 2008, which is hereby incorporated by reference herein in its entirety.

What is claimed is:

1. A liquid ejection head comprising:

a plurality of ejection orifices configured to allow liquid to be ejected therethrough;

a plurality of passages communicating with the plurality of respective ejection orifices and with a plurality of respective pressure chambers, each of the plurality of pressure chambers accommodating an energy generating element therein, the energy generating element being configured to generate energy for ejecting the liquid;

a supply port configured to supply the liquid to the plurality of passages; and a filter including a plurality of substantially cylindrical members arranged in a region between the supply port and the plurality of passages, the filter having a plurality of openings, wherein each of the plurality of ejection orifices has a cross section having a substantially circular shape with a larger diameter and a smaller diameter in a direction substantially perpendicular to a direction in which the liquid is ejected, wherein each of the plurality of openings of the filter has a cross section having a substantially rectangular shape with a longer side and a shorter side in a direction substantially perpendicular to a direction in which the liquid is supplied, and wherein the following relationships are satisfied:

$$D1>L1,\ D1<D2,\ \text{and}\ D2>L2\geqq D1$$

where D1 is the smaller diameter of the ejection orifice, D2 is the larger diameter, L1 is the shorter side of the opening, and L2 is the longer side.

2. The liquid ejection head according to claim 1, wherein the plurality of pressure chambers are disposed in a predetermined arrangement direction, and wherein the predetermined arrangement direction and the shorter side are substantially parallel to each other.

3. The liquid ejection head according to claim 1, wherein the plurality of passages comprise a first passage and a second passage, and the second passage is shorter than the first passage and adjacent to the first passage, and wherein the plurality of openings of the filter comprise a first opening corresponding to the first passage and a second opening corresponding to the second passage, and the first opening is larger in size than the second opening.

4. A liquid ejection head comprising:

a plurality of ejection orifices configured to allow liquid to be ejected therethrough;

a plurality of passages communicating with the plurality of respective ejection orifices and with a plurality of respective pressure chambers, each of the plurality of pressure chambers accommodating an energy generating element therein, the energy generating element being configured to generate energy for ejecting the liquid;

a supply port configured to supply the liquid to the plurality of passages; and a filter including a plurality of substantially cylindrical members arranged in a region between the supply port and the plurality of passages, the filter having a plurality of openings, wherein each of the plurality of ejection orifices has a cross section having a substantially circular shape with a larger diameter and a smaller diameter in a direction substantially perpendicular to a direction in which the liquid is ejected, wherein each of the plurality of openings of the filter has a cross section having a substantially trapezoidal shape with an upper base, a lower base, and a height in a direction substantially perpendicular to a direction in which the liquid is supplied, and wherein the following relationships are satisfied:

$$D1>L11,\ D1>L12,\ \text{and}\ D2>L2\geqq D1$$

where D1 is the smaller diameter of the ejection orifice, D2 is the larger diameter, L11 is the upper base of the opening, L12 is the lower base, and L2 is the height.

5. The liquid ejection head according to claim 4, wherein the plurality of pressure chambers are disposed in a predetermined arrangement direction, and wherein the predetermined arrangement direction, the upper base, and the lower base are substantially parallel to each other.

* * * * *